US006779494B1

(12) United States Patent
Aswani

(10) Patent No.: US 6,779,494 B1
(45) Date of Patent: Aug. 24, 2004

(54) BALANCED BARREL-CAM INTERNAL-COMBUSTION ENGINE

(76) Inventor: Deepak Jayanti Aswani, 7122 Timber Ridge Trail, Westland, MI (US) 48185-7666

( * ) Notice: Subject to any disclaimer, the term of this patent is extended or adjusted under 35 U.S.C. 154(b) by 0 days.

(21) Appl. No.: 10/698,226

(22) Filed: Nov. 1, 2003

Related U.S. Application Data

(60) Provisional application No. 60/479,262, filed on Jun. 18, 2003.

(51) Int. Cl.[7] ..... F02B 75/18
(52) U.S. Cl. ..... 123/56.1; 123/56.2
(58) Field of Search ..... 123/90.24, 56.8, 123/56.1, 56.2, 56.7

(56) References Cited

U.S. PATENT DOCUMENTS

| | | | |
|---|---|---|---|
| 1,181,463 A | 5/1916 | La Fontaine | |
| 1,788,140 A | 1/1931 | Woolson | |
| 2,237,621 A | 4/1941 | Herrmann | |
| 2,237,989 A | 4/1941 | Herrmann | |
| 2,243,817 A | 5/1941 | Herrmann | |
| 2,243,818 A | 5/1941 | Herrmann | |
| 2,243,819 A | 5/1941 | Herrmann | |
| 2,243,820 A | 5/1941 | Herrmann | |
| 2,243,821 A | 5/1941 | Herrmann | |
| 2,243,822 A | 5/1941 | Herrmann | |
| 2,401,466 A | 6/1946 | Davis et al. | |
| 4,090,478 A | 5/1978 | Trimble et al. | |
| 4,834,033 A | 5/1989 | Larsen | |
| 6,279,520 B1 * | 8/2001 | Lowi, Jr. | 123/56.1 |

* cited by examiner

*Primary Examiner*—Thomas Denion
*Assistant Examiner*—Zelalem Eshete

(57) ABSTRACT

A multi-cylinder internal-combustion engine where translation between piston reciprocating motion and rotational motion occurs via a pair of conjugate axial cams with dual rolling followers on the piston-assemblies—one rolling follower per conjugate axial cam. A pair of conjugate axial cams form a grooved or ribbed axial cam that is form-closed and is frequently referred to as a barrel-cam. Balanced operation is ensured through a series of relative constraints between the number and masses of uniformly spaced piston-assemblies about the barrel-cam cylinder, the shape of the barrel-cam's piston-assembly displacement profile, and also the valve-assemblies along with their actuation properties.

2 Claims, 9 Drawing Sheets

BALANCED BARREL-CAM INTERNAL-COMBUSTION ENGINE

CROSS-REFERENCE TO RELATED APPLICATIONS

Priority claimed through Provisional Patent Application No. 60/479,262 filed on Jun. 18, 2003, entitled "Balanced barrel cam internal combustion engine".

FEDERALLY SPONSORED RESEARCH

Not applicable.

SEQUENCE LISTING OR PROGRAM

Not applicable.

BACKGROUND—FIELD OF INVENTION

This invention relates to barrel-cam internal-combustion engines (reciprocating piston internal-combustion engines where motion conversion takes place via a pair of conjugate axial cams) that are specifically improved by assuring naturally balanced operation under a greater variety of as well as simpler configurations than before.

BACKGROUND—DISCUSSION OF PRIOR ART

Cost reduction has always been an area of strong interest for internal-combustion engines considering their market span and production quantities. The barrel-cam engine (a reciprocating piston internal-combustion engine where motion conversion takes place via a pair of conjugate axial cams) has been one of the attempts at cost reduction for internal-combustion engines. Prior art of barrel-cam engines claim reduction of the number of parts relative to conventional crank-type engines without sacrificing reliability, performance/efficiency, or increasing NVH (Noise and Vibrational Harshness). Though the motion conversion mechanism for barrel-cam engines uses the same number and complexity of parts as a conventional crank-type engine, the prior art anticipates reducing the components needed for valve actuation and avoiding the need for balance shafts in certain configurations.

Patent applications by those including Gresse (251,607:United Kingdom) and Herrmann (U.S. Pat. No. 2,237,621 and related subsequent patents) anticipated certain engine simplifications due to the structure of the barrel-cam engine. Specifically, they anticipated the ability to actuate cylinder valves by secondary cams directly coupled to the barrel-cam shaft (the shaft analogous to the crankshaft of conventional IC engines). This is made possible because of two reasons: Firstly, the barrel-cam shaft can always be extended to be close to the cylinder heads due to the planetary arrangement of the piston-assemblies about the barrel-cam. Secondly, and more importantly, barrel-cam engines are not restricted to a single piston-assembly reciprocation per shaft revolution. Therefore the engine can be easily designed such that the rate of rotation of the valve-actuating-cams and barrel-cam shaft arc compatible. For example, in a four cycle engine, the intake and exhaust valve groups per cylinder each lift once every four cycles, or every 2 piston-assembly oscillations. Therefore, in order for the rotation rates of the valve-actuating-cams and barrel-cam shaft to be compatible, for n defined as the # single piston-assembly oscillations defined through one rotation of the barrel-cam's piston-assembly displacement profile, n must be divisible by 2 and the intake and exhaust cam must each have n/2 lobes. Directly coupling the valve-activation-cams to the barrel-cam shaft, as proposed, avoids the need for a rotational power transfer mechanism such as gear and belt or chain and sprocket which are needed in OHC crank-type engines. The planetary arrangement of piston-assemblies also reduces the member of cam surfaces needed since the engine can be designed such that each planetary bank of cylinders per side of the barrel-cam (across the plane normal to the barrel-cam shaft) can share the same pair of cam surfaces unlike crank-type engines where each cylinder has its own pair of cams, at minimum. Because of the unique arrangement of the pistons relative to the output shaft, the barrel-cam engine can easily accomodate axial cams or radial cams with rocker arms to actuate the valves.

A number of patents such as those by Herrmann (U.S. Pat. No. 2,237,621 and associated patents) and Trimble et al. (U.S. Pat. No. 4,090,478) set one of their objectives to have a balanced engine without balance shafts. Certain cylinder configurations of crank-type engines require balance shafts that spin at twice the crankshaft speed to balance the 2nd harmonics of vibration. Avoiding the need for balance shafts and their associated rotational power transfer mechanisms results in yet another reduction in part numbers. The series of patents by Herrmann (U.S. Pat. No. 2,237,621 and related subsequent patents) use 6 double-ended piston-assemblies in a planetary arrangement about a barrel-cam having a 4 lobe sinusoidal piston-assembly displacement profile corresponding to 2 oscillations per revolution per piston-assembly. This configuration has the piston-assemblies naturally balanced. The configuration allows partial balancing of valve-assembly forces in the direction of piston motion by generally opposing actuation of valves. Valve-assembly forces in the direction of piston motion account for a large portion of the valve-assembly forces because the angle between the valves' direction of motion and that of the pistons is typically not very large. However cycle ordering constraints restrict opposing valves from being paired exclusively on a per piston-assembly basis and hence torque imbalances by valve-assembly actuation still exist. Trimble et al. offer an approach to have a completely balanced engine in a more general case at the expense of more parts and increased size. Trimble et al. anticipate balancing by placing along a common barrel-cam shaft both an arbitrary barrel-cam engine and its "mirror image" across the plane normal to the barrel-cam shaft. This balances all piston-assembly and valve-assembly forces as well as moments. However, a pair of "mirrored" barrel-cam engines require that the piston-assemblies from both units along the same line of motion simultaneously move inward and outward. Therefore, the piston-assemblies, in line between both opposite units, cannot be connected. As a result, each unit requires its own barrel-cam. Consequently, for the same number of cylinders, this engine occupies more space than an engine using double-ended piston-assemblies with a single barrel-cam.

Fortunately, barrel-cam engines share the same fluid dynamics and thermodynamics as conventional crank-type engines since their combustion chambers, piston shape, and valve arrangement can be made identical to their conventional counterparts. This simplifies development since the only new considerations in design are the structural and reliability issues for the motion conversion mechanisms. Operational prototypes of barrel-cam engines have been constructed to date. Extensive development has been conducted by Dyna-Cam Engine Corp. At the time of the present invention, Dyna-Cam Engine Corp. claims to have developed their seventh generation engine based on the work by Herrmann (U.S. Pat. No. 2,237,621 and related subsequent patents). Their series of engines consisted of 12 cylinder, 6 double-ended piston-assembly, barrel-cam engines. Dyna-Cam Engine Corp. presently has a barrel-cam engine of this type in production for sale. Also Dyna-Cam Engine Corp. claims to have demonstrated a number of advantages in using a barrel-cam engine including quieter vibration-free operation and a significant reduction in number of parts compared to an equivalent crank-type internal-combustion engine. The ReJen Company is also developing a barrel-cam engine that is diesel powered with a regenerated cycle for general aviation aircraft propulsion and shipboard power generation. The ReJen company has received support from government contracts through NASA and the US Navy as well as support through partnerships with Caterpillar, Inc and Alvin Lowi & Assoc.

BACKGROUND—OBJECTS AND ADVANTAGES

The 12 cylinder, 6 double-ended piston-assembly, barrel-cam engine developed by Dyna-Cam Engine Corp. is particularly useful when a high number of cylinders are needed as in marine, industrial, heavy automotive, and aviation applications. However it is not well suited for applications that are cost sensitive and historically have a low number of cylinders such as in the personal automotive market. The idea proposed by Trimble et al. to utilize two "mirrored" barrel-cam engine units along a common barrel-cam shaft allows the use of as few as 2 cylinders for a fully balanced engine, but this comes at the expense of increased engine size and cost from an additional barrel-cam. The object of this invention is to offer more compact and simpler barrel-cam engine configurations that are suitable for cost sensitive applications such as the personal automotive market, while maintaining the exceptional natural balance characteristics possible with barrel-cam engines. Specifically, a class of naturally balanced engines is proposed where only a single barrel-cam is needed by posing relative constraints between the number and masses of uniformly spaced piston-assemblies about the barrel-cam cylinder, the shape of the barrel-cam's piston-assembly displacement profile, and also the valve-assemblies along with their actuation properties. This allows for choice in the number of cylinders for a naturally balanced engine. For example, these constraints show that a much simpler 4 cylinder single barrel-cam engine that is naturally balanced can be realized. Furthermore, through these constraints, naturally balanced operation is ensured for a class of barrel-cam piston-assembly displacement profiles that is more general than the sinusoidal displacement profile that has been favored in prior art for single barrel-cam engines. Relaxing the choices for barrel-cam piston-assembly displacement profiles can lend to better application specific design of barrel internal-combustion engines.

SUMMARY

The barrel-cam engine belongs to a class of engines described as multi-cylinder internal-combustion engines where translation between piston-assembly reciprocating motion and rotational motion occurs via a pair of conjugate axial cams with dual rolling followers on the piston-assemblies—one rolling follower per conjugate axial cam. A pair of conjugate axial cams form a grooved or ribbed axial cam that is form-closed and is frequently referred to as a barrel-cam. Specifically, the embodiment of the motion translating portion includes a piston-assembly, a barrel, and a restrained fixture where:

The piston-assembly comprises an individual or pair of pistons attached to the end(s) of a fixture where the fixture has two independently rolling bearings that serve as followers to the conjugate axial cams described later, and also has a linear bearing segment. The linear bearings distribute part of the friction-inducing action-reaction force between the piston and combustion chamber walls to the less hostile and easy-to-lubricate environment of the linear bearing. The linear bearing serves to restrict the piston-assembly to exclusively reciprocating motion without the piston-assembly rotating about the direction of reciprocation. In other words, the linear bearing resists lateral motion of the piston-assembly relative to the direction of reciprocation and resists torque about the direction of reciprocation.

The barrel comprises a rotating cylinder with conjugate axial cam surfaces on its outer wall, where "conjugate" implies that the cam surfaces support followers in opposing directions of force, and such that one of the two independently rolling bearings of the piston-assembly continuously follows one of the cam surfaces and the other independently rolling bearing continuously follows the other cam surface. The conjugate nature of the cams ensures that at any point, piston-assembly to barrel or barrel to piston-assembly motion transfer can take place, while the piston-assembly remains in a continuous cycle of motion.

The restrained fixture comprises the engine block in the classical sense (that holds the reciprocating piston-assemblies and engine valve-assemblies), which additionally holds the rotating barrel-cam cylinder and has the linear bearing portions that are complementary to those of the piston-assemblies.

In multi-cylinder form, the piston-assemblies are in uniformly spaced planetary arrangement about the barrel.

The proposed balanced barrel-cam engine specifically comprises of an engine of the above described class, which under the following conditions (a) and (b), naturally minimizes NVH (Noise and Vibrational Harshness) by balancing all aggregate piston-assembly forces/torques and also by optimally balancing the majority of intake/exhaust valve-assembly forces/torques. Conditions (a) and (b) accomplish this without the need of balance shafts, opposing cylinder arrangement, or "mirror" imaging of another barrel-cam engine. Given a multi-cylinder engine of the form described above, define j=# multiple of n in harmonics of the barrel-cam's piston-assembly displacement profile (a positive integer)

n=# single piston-assembly oscillations defined through one rotation of the barrel-cam's piston-assembly displacement profile (a positive integer)

p=# piston-assemblies (a positive integer greater than one)

Where the barrel-cam's piston-assembly displacement profile, in addition to the above, is further constrained to be continuously differentiable and piecewise monotonic on the 2×n segments between the consecutive pairs of TDC (top dead center) and BDC (bottom dead center).

Condition (a): Relaxed Sufficient Condition for Piston-Assembly Balancing—If p is not a factor of (n×j−1), (n×j), and (n×j+1) for all j that define the barrel-cam's piston-assembly displacement profile, then perfect balancing of aggregate piston-assembly forces and torques is achieved.

Condition (b): Relaxed Sufficient Condition for Valve-Assembly Balancing—If n is a multiple of 2 and if predetermined perturbations are made to the barrel-cam's piston-assembly displacement profile (that initially exhibits piston-assembly balance through Condition (a)), the valve-assembly force imbalances can be optimally balanced in the direction of piston motion through the forces induced by piston-assembly imbalance.

DRAWINGS

In the drawings, closely related figures have the same number but different alphabetic suffixes.

Figure 2:
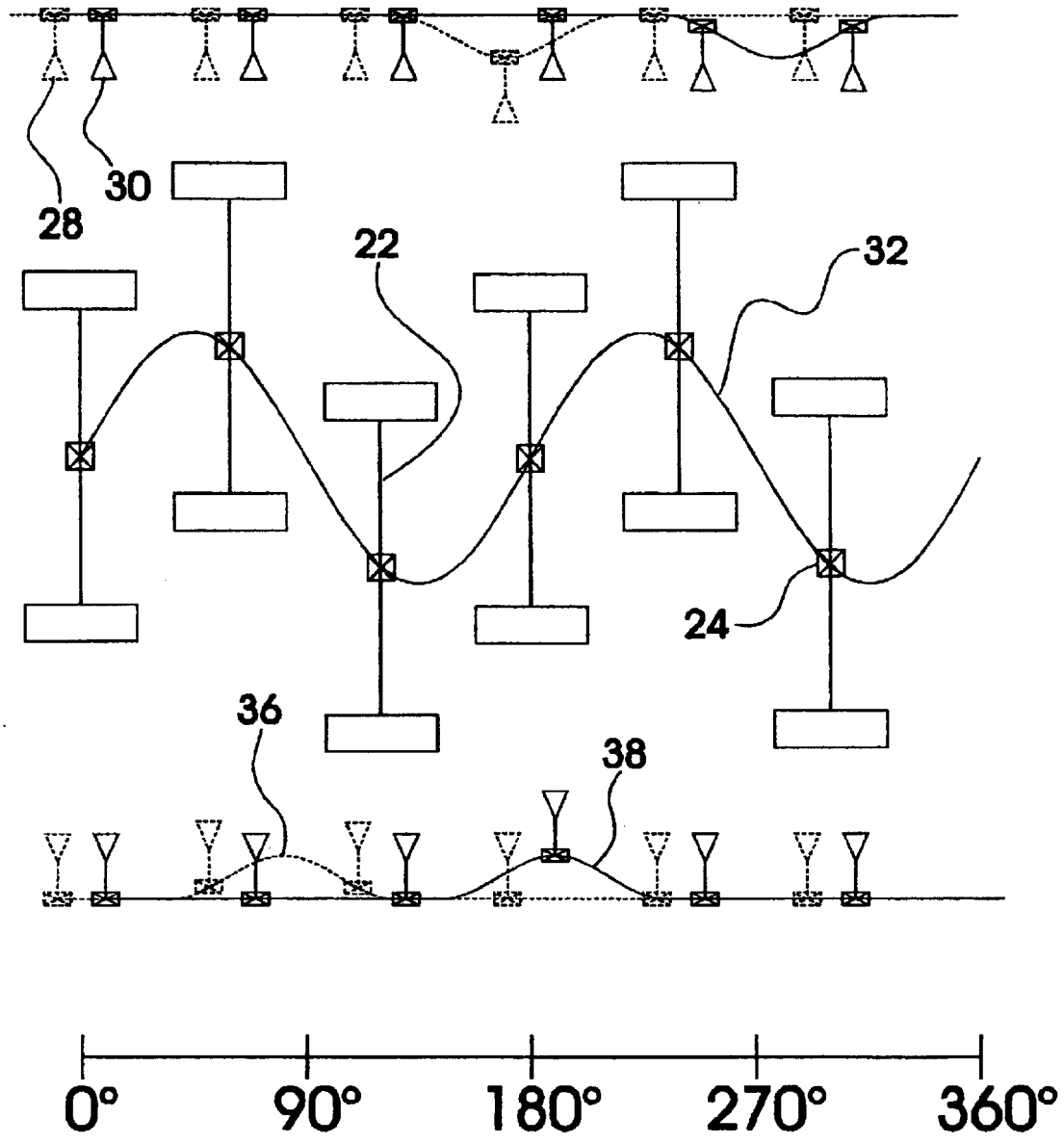
FIG. 2 (Prior Art)

FIG. 2 shows a conceptual drawing of the mostly balanced, 12 cylinder, 2 reciprocation per revolution, sinusoidal piston-assembly displacement profile, barrel-cam engine from prior art by Herrmann in patent U.S. Pat. No. 2,237,621 and related subsequent patents.

Figure 3:
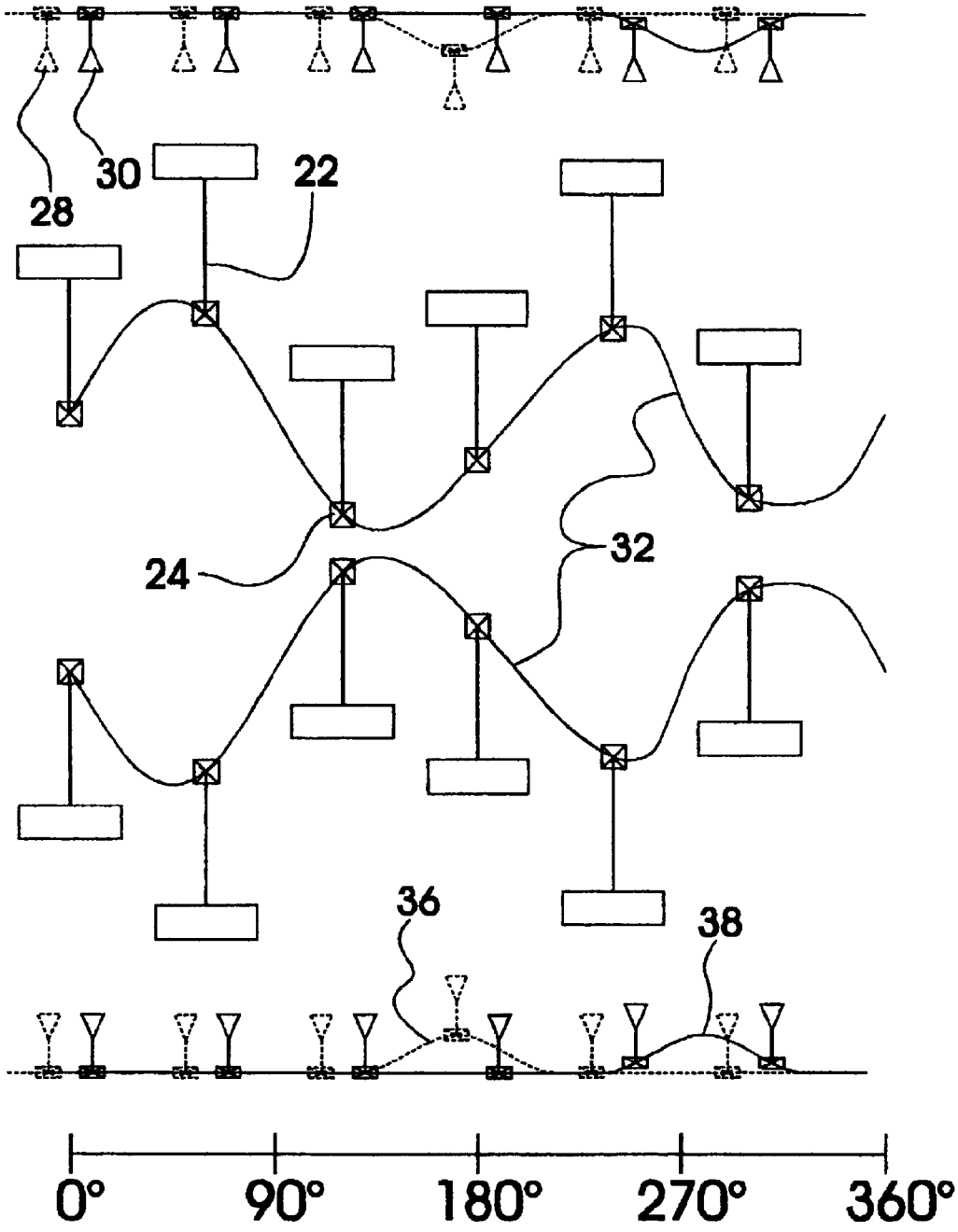
FIG. 3 (Prior Art)

FIG. 3 shows a conceptual drawing of a completely balanced, 12 cylinder, 2 reciprocation per revolution, arbitrary piston-assembly displacement profile, barrel-cam engine from prior art by Trimble et al. in patent U.S. Pat. No. 4,090,478.

Figure 4:
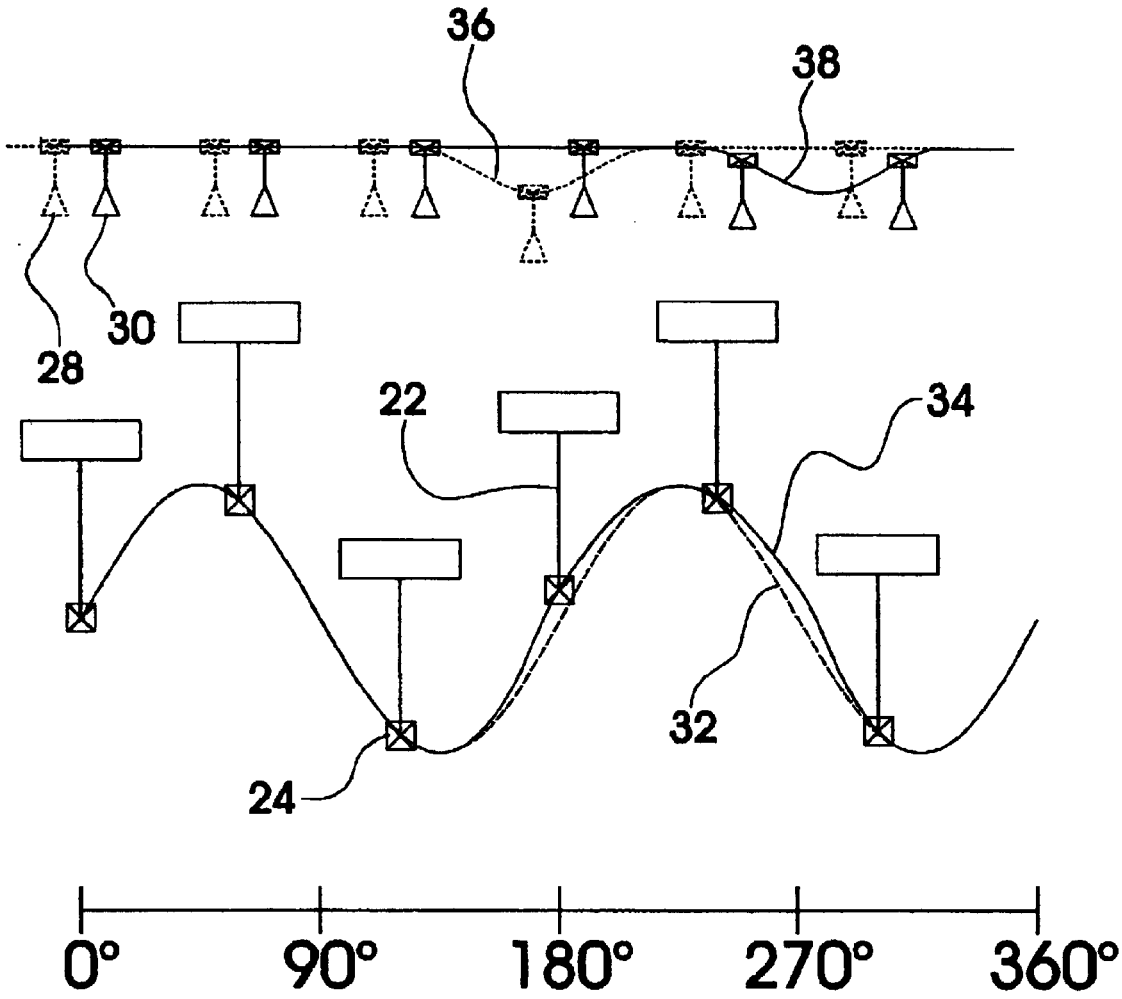

FIG. 4 shows a conceptual drawing of a completely balanced, 6 cylinder, 2 reciprocation per revolution, sinusoidal piston-assembly displacement profile with valve-assembly balancing perturbations, barrel-cam engine as proposed in the present invention.

Figure 5:
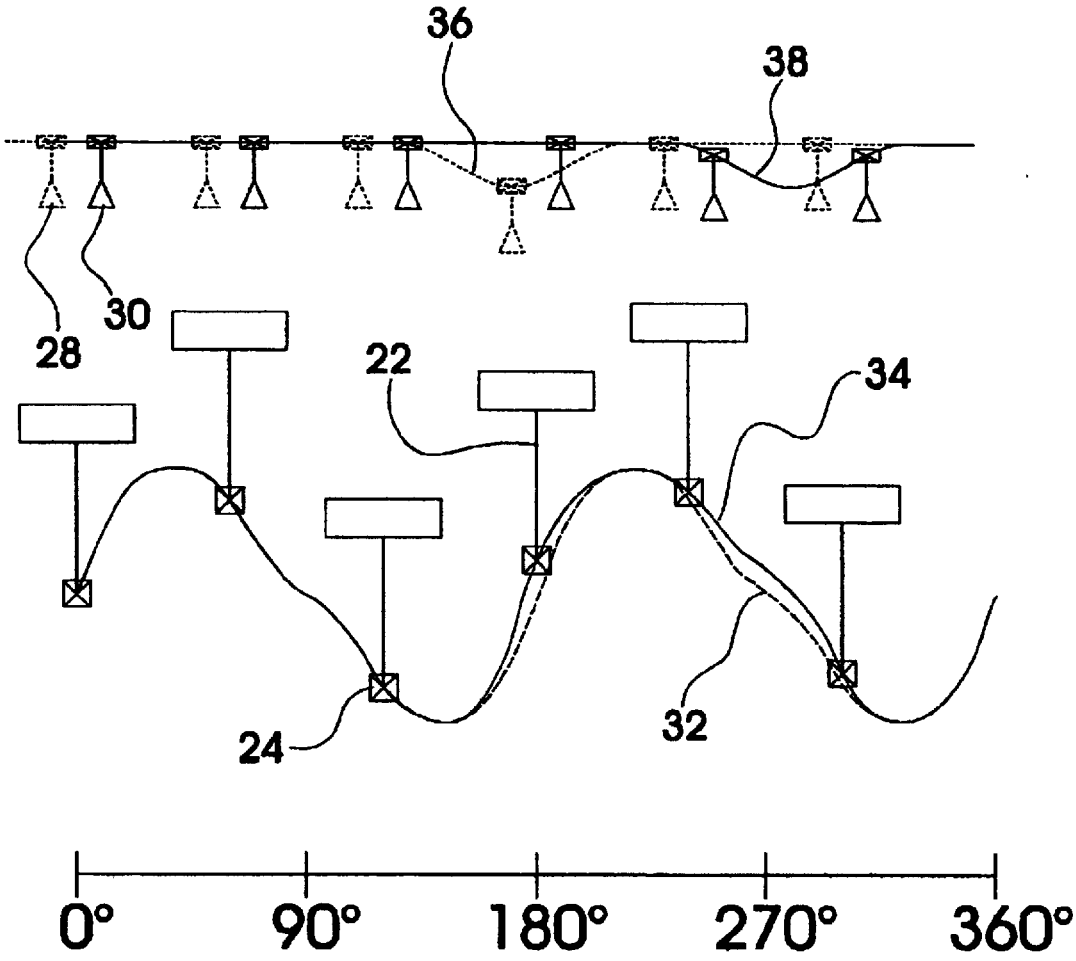

FIG. 5 shows a conceptual drawing of a completely balanced, 6 cylinder, 2 reciprocation per revolution, sinusoidal (including arbitrary 2nd and 4th harmonics) piston-assembly displacement profile with valve-assembly balancing perturbations, barrel-cam engine as proposed in the present invention.

Figure 6:
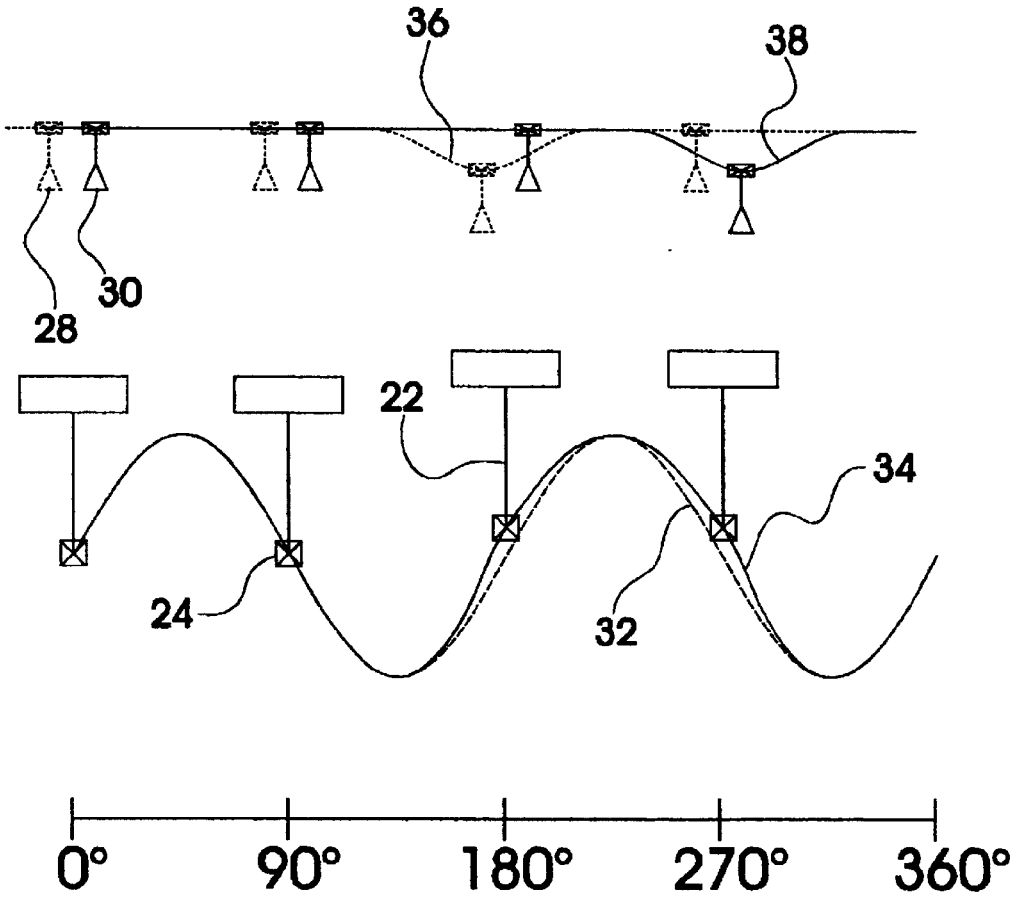

FIG. 6 shows a conceptual drawing of a completely balanced, 4 cylinder, 2 reciprocation per revolution, sinusoidal piston-assembly displacement profile with valve-assembly balancing perturbations, barrel-cam engine as proposed in the present invention.

Figure 7:
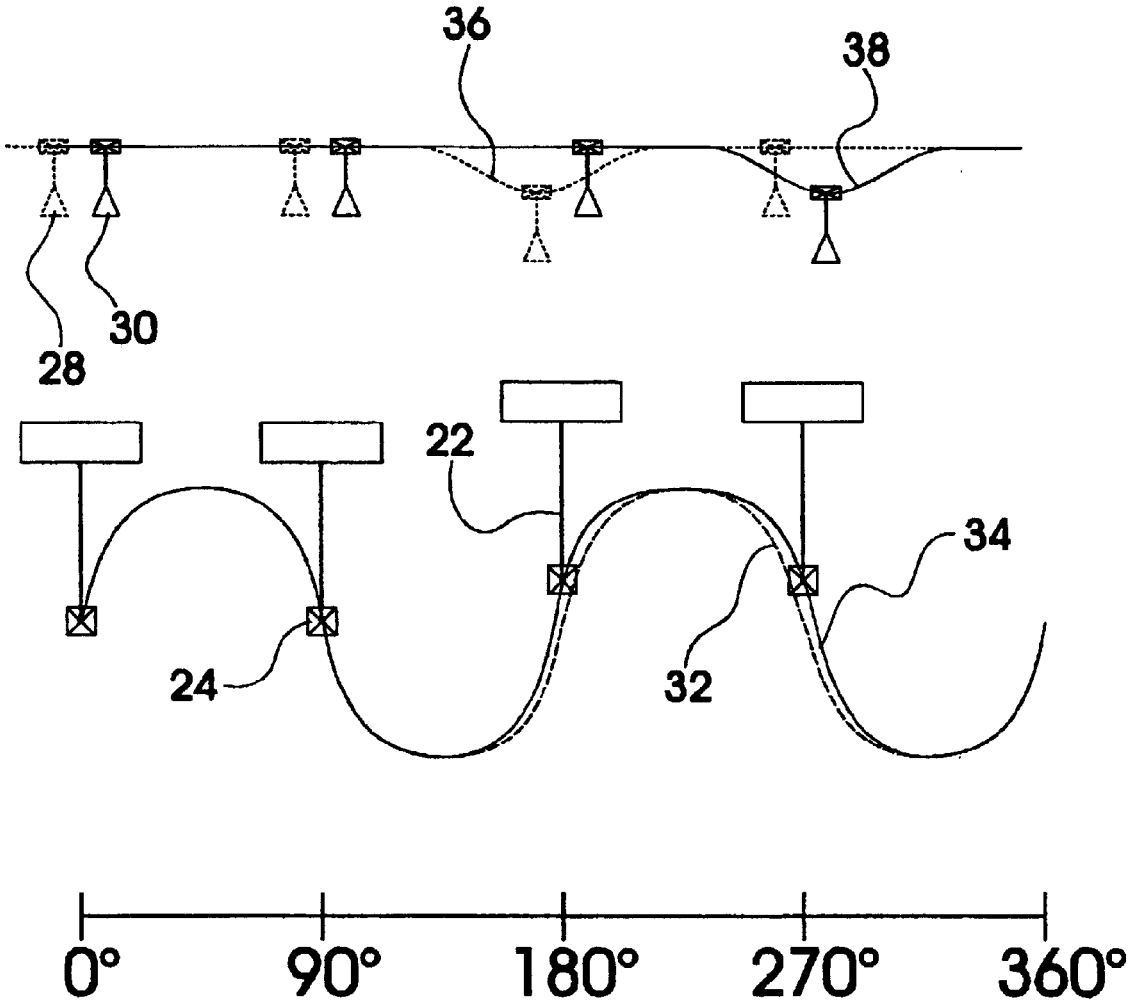

FIG. 7 shows a conceptual drawing of a completely balanced, 4 cylinder, 2 reciprocation per revolution, sinusoidal (including an arbitrary 3rd harmonic) piston-assembly displacement profile with valve-assembly balancing perturbations, barrel cam engine as proposed in the present invention.

Figure 8:
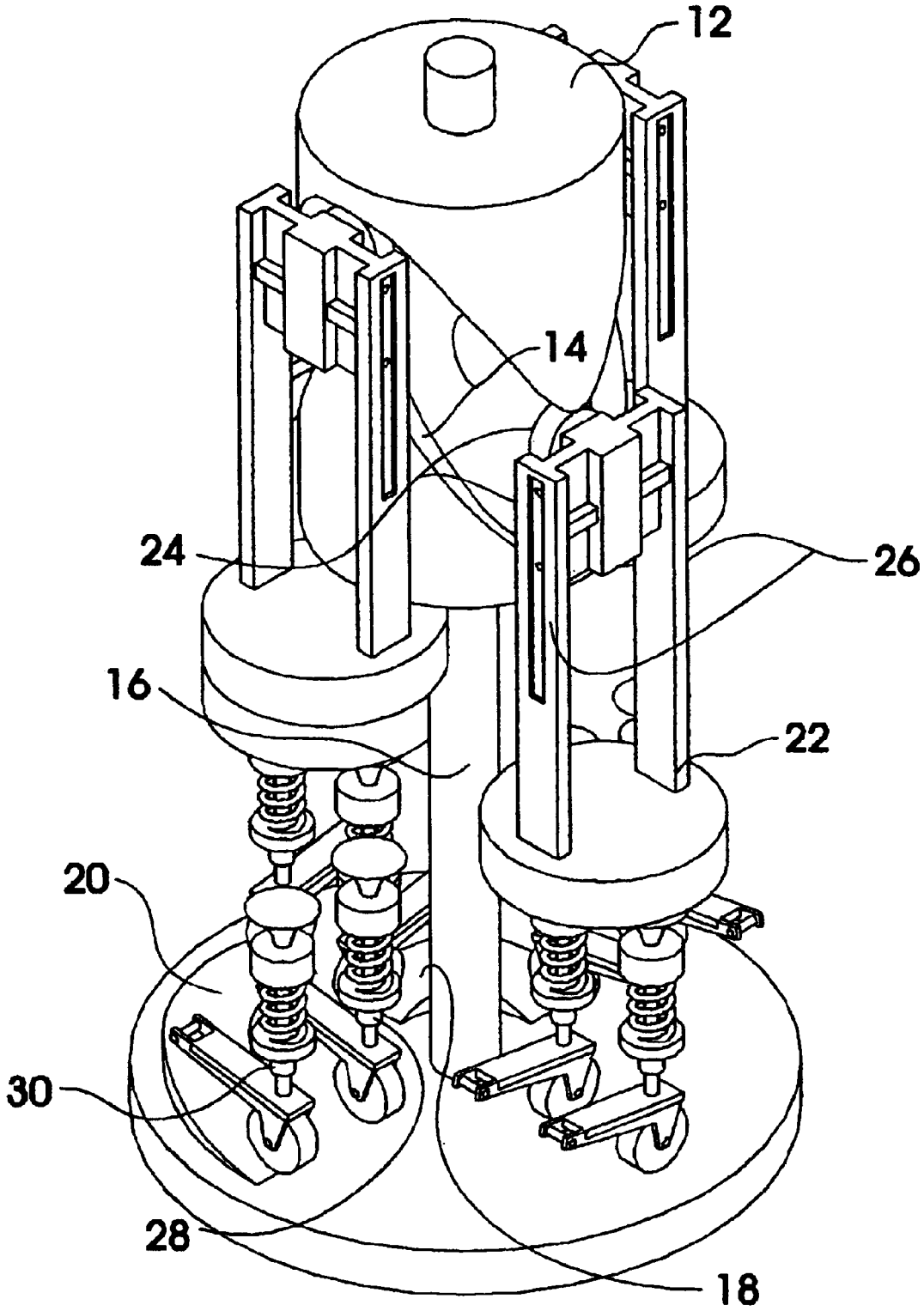

FIG. 8 shows an isometric view of the piston-assembly arrangement made possible by FIG. 6 or FIG. 7 for a completely balanced, 4 cylinder, 2 reciprocation per revolution barrel-cam engine.

REFERENCE NUMERALS

12 barrel-cam cylinder
14 barrel-cam (conjugate axial cams)
16 barrel-cam shaft
18 intake valve-actuating-cams
20 exhaust valve-actuating-cams
22 piston-assembly
24 piston-assembly conjugate axial cam rolling followers
26 piston-assembly linear bearing(s)
28 intake valve-assembly
30 exhaust valve-assembly
32 unperturbed representative barrel-cam piston-assembly displacement profile
34 perturbed representative barrel-mm piston-assembly displacement profile
36 representative intake valve-actuating-cam displacement profile
38 representative exhaust valve-actuating-cam displacement profile

DETAILED DESCRIPTION/OPERATION

Figure 1A:
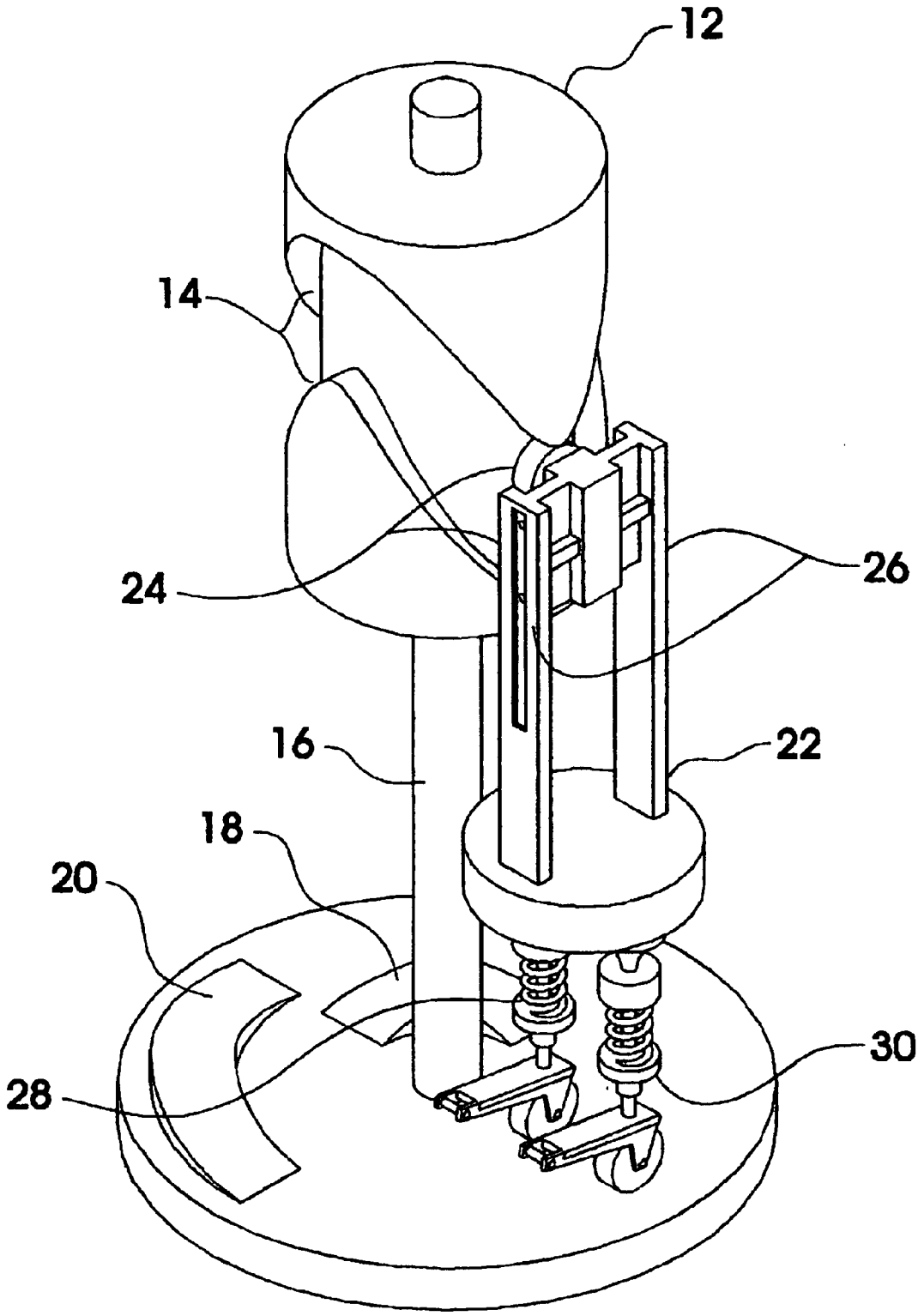
FIG. 1A (Prior Art)
FIG. 1A shows an isometric view of a generic, single cylinder, 2 reciprocation per revolution, barrel-cam engine as realized in prior art.
Figure 1B:
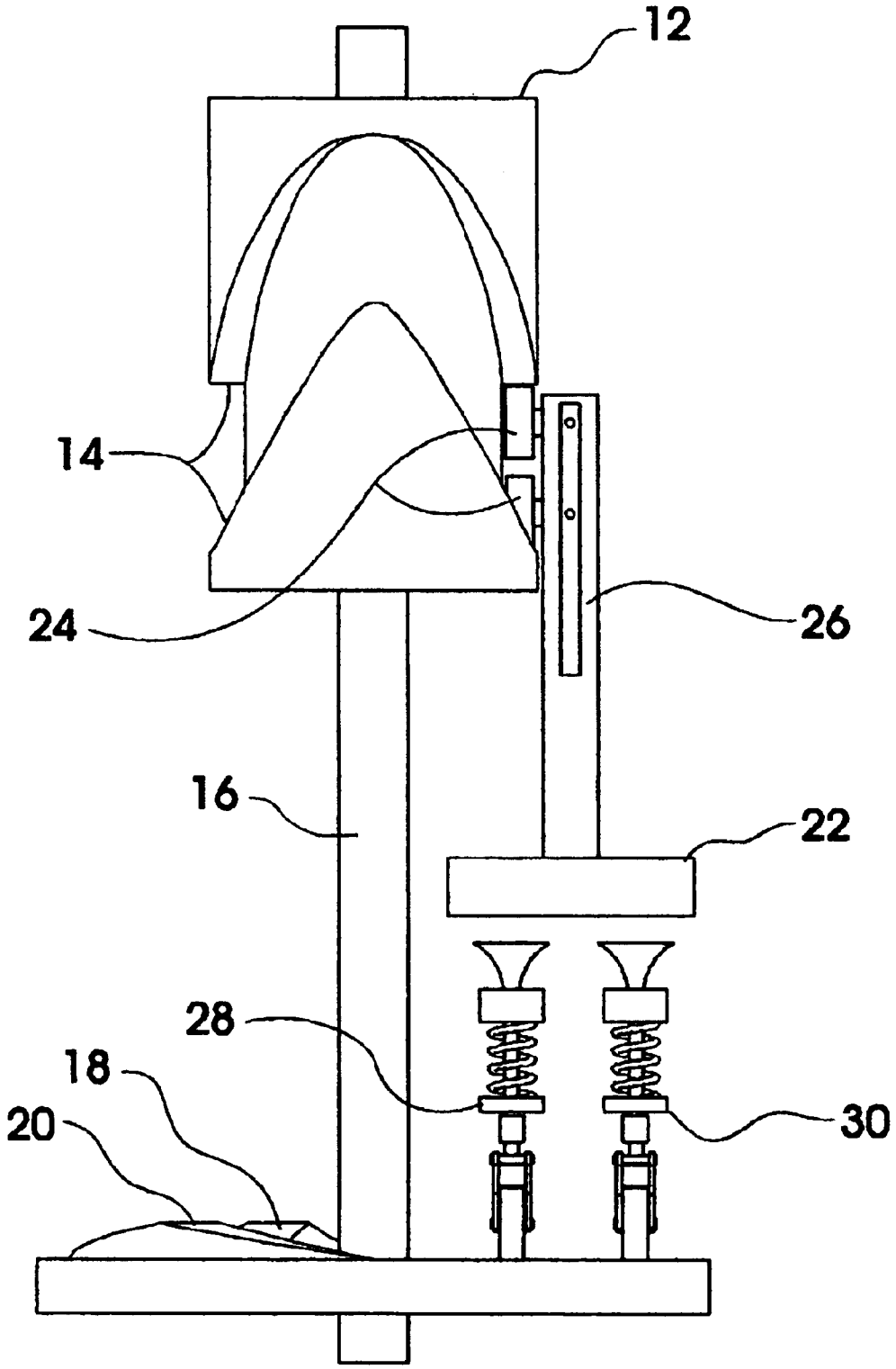
FIG. 1B (Prior Art)
FIG. 1B shows a side view of a generic, single cylinder, 2 reciprocation per revolution, barrel-cam engine as realized in prior art.

FIGS 1A, 1B—Prior Art

FIGS 1A and 1B show isometric and side views, respectively, of a generic, single cylinder, 2 reciprocation per revolution, barrel-cam engine. The piston-assembly 22 comprises a piston with fixture 24 that has two independently rolling bearings that serve as followers to the conjugate axial cams 14, and a linear bearing segment 26. The linear bearings 26 distribute part of the friction-inducing action-reaction force acting between the piston and combustion chamber walls to the less hostile and easy-to-lubricate environment of the linear bearings 26. The linear bearings 26 along with their counterparts in the engine block (not depicted) serve to restrict the piston-assembly 22 to exclusively reciprocating motion without the piston-assembly 22 rotating about the direction of reciprocation, so in other words, to resist lateral motion of the piston-assembly 22 relative to the direction of reciprocation and to resist torque about the direction of reciprocation. The barrel-cam cylinder 12 comprises a rotating cylinder with conjugate axial cam surfaces 14 on its outer wall, where "conjugate" implies that the cam surfaces support followers in opposing directions of force, and such that each one from the pair of conjugate cam rolling followers 24 maintains continuous contact with their respective conjugate cam surfaces 14. The conjugate nature of the cams ensures that at any point, piston-assembly 22 to barrel 12 or barrel 12 to piston-assembly 22 motion transfer can take place, while the piston-assembly 22 remains in a continuous cycle of motion. Power from the engine is obtained through the barrel-cam shaft 16 which is connected to the barrel-cam cylinder 12. For a 2 reciprocation per revolution, 4 cycle, barrel-cam engine, single lobe intake valve-actuating-cams 18 and exhaust valve-actuating-cams 20 can be directly coupled to the barrel-cam shaft 16 since the rate of rotation for the single lobe cams are compatible to that of the barrel-cam cylinder 12.

FIG. 2—Prior Art

FIG. 2 shows a conceptual drawing of the mostly balanced, 12 cylinder, 2 reciprocation per revolution, sinusoidal piston-assembly displacement profile, barrel-cam engine by Herrmann associated through patent U.S. Pat. No. 2,237,621 and related subsequent patents. FIG. 2 shows such a 12 cylinder, 6 double ended piston-assembly, barrel-cam engine that is "unrolled". The representative barrel-cam piston-assembly displacement profile 32, representative intake valve-actuating-cam displacement profiles 36, and representative exhaust valve-actuating-cam displacement profiles 38 are connected in an actual engine by the barrel-cam shaft. As depicted in FIG. 2, each cam profile (32, 36, and 38) connects with itself at the 0° and 360° points. The cams (32, 36, and 38) all rotate through the range of 0° and 360° positions in unison because of their connection. The piston-assemblies 22 move in exclusively an upwards and downwards fashion. The sinusoidal piston-assembly displacement profile balances all piston-assembly forces and torques, as has been demonstrated in application. However, all the valve-assembly forces and torques cannot be balanced. The figure shows that the valve-assembly actuation forces are mostly balanced. However, the actuated valves are not always directly opposite from each other on each double-ended piston-assembly and hence torque imbalances occur. Placing the actuated valves directly opposite from each other is not an option because it violates the 4 cycle firing order. Between the intake and exhaust valve actuation, the piston-assembly 22 must have a motion that converges toward the ported side (valve side) of the combustion chamber. This makes it impossible to exclusively actuate valves directly opposite each other given double-ended piston-assemblies.

FIG. 3—Prior Art

FIG. 3 shows a conceptual drawing of a completely balanced, 12 cylinder, 2 reciprocation per revolution, arbitrary piston-assembly displacement profile, barrel-cam engine by Trimble et al. associated through patent 4,090,478. FIG. 3 shows such a 12 cylinder barrel-cam engine comprising two "mirrored" 6 cylinder barrel-cam engines that is "unrolled". The components 32, 36, and 38 are each connected with itself at the 0° and 360° points and rotate in unison similarly as in FIG. 2. FIG. 3 however has an additional representative barrel-cam piston-assembly displacement profile 32 since the two banks of cylinders are not connected as double-ended piston-assemblies as in FIG. 2. This configuration "mirrors" all imbalanced piston-assembly and valve-assembly forces as well as torques. Therefore, for an arbitrary pair of "mirrored" displacement profile sets (32, 34, and 36) the engine will remain completely balanced. However, as apparent in FIG. 3, this comes at the expense of an additional barrel-cam and increased engine size.

FIG. 4—Preferred Embodiment

FIG. 4 shows a conceptual drawing of a completely balanced, 6 cylinder, 2 reciprocation per revolution, sinusoidal piston-assembly displacement profile with valve-assembly balancing perturbations, barrel-cam engine as proposed in the present invention. FIG. 4 shows such a 6 cylinder barrel-cam engine that is "unrolled". The components 34, 36, and 38 are each connected with itself at the 0° and 360° points and rotate in unison similarly as in FIG. 2. In FIG. 4, n, the number of single piston-assembly oscillations defined through one rotation of the barrel-cam's piston-assembly displacement profile, is 2. Since the unperturbed piston-assembly displacement profile 32 is sinusoidal, j, the multiple of n in harmonics, is 1. Thus 6 piston-assemblies, or p=6, is not a factor of $(n\times j-1)=1$, $(n\times j)=2$, and $(n\times j+1)=3$. As a result, the piston-assembly forces and torques are balanced for the unperturbed piston-assembly displacement profile 32. The perturbations to the barrel-cam's piston-assembly displacement profile that result in 34 balance the component of valve-assembly actuation forces in the direction of piston motion without introducing new torques.

FIG. 5—Preferred Embodiment

FIG. 5 shows a conceptual drawing of a completely balanced, 6 cylinder, 2 reciprocation per revolution, sinusoidal (including arbitrary 2nd and 4th harmonics) piston-assembly displacement profile with valve-assembly balancing perturbations, barrel-cam engine as proposed in the present invention. FIG. 5 shows such a 6 cylinder barrel-cam engine that is "unrolled". The components 34, 36, and 38 are each connected with itself at the 0° and 360° points and rotate in unison similarly as in FIG. 2. In FIG. 5, n, the number of single piston-assembly oscillations defined through one rotation of the barrel-cam's piston-assembly displacement profile, is 2. Since the unperturbed piston-assembly displacement profile 32 is sinusoidal with 2nd and 4th harmonics, j, the multiple of n in harmonics, has the set of possible values of {1, 2, 4}. Thus 6 piston-assemblies, or p=6, is not a factor of any of the elements of $\{(n\times j-1)\}=\{1,3,7\}$, $\{(n\times j)\}=\{2,4,8\}$, and $\{(n\times j+1)\}=\{3,5,9\}$. As a result, the piston-assembly forces and torques are balanced for the unperturbed piston-assembly displacement profile 32. The perturbations to the barrel-cam's piston-assembly displacement profile that result in 34 balance the component of valve-assembly actuation forces in the direction of piston motion without introducing new torques. FIG. 5 is an illustration that barrel-cam piston-assembly displacement profiles where the upstroke and downstroke shaft rotation are unequal can also result in balanced operation.

FIG. 6—Preferred Embodiment

FIG. 6 shows a conceptual drawing of a completely balanced, 4 cylinder, 2 reciprocation per revolution, sinusoidal piston-assembly displacement profile with valve-assembly balancing perturbations, barrel-cam engine as proposed in the present invention. FIG. 6 shows such a 4 cylinder barrel-cam engine that is "unrolled". The components 34, 36, and 38 are each connected with itself at the 0° and 360° points and rotate in unison similarly as in FIG. 2. In FIG. 6, n, the number of single piston-assembly oscillations defined through one rotation of the barrel-cam's piston-assembly displacement profile, is 2. Since the unperturbed piston-assembly displacement profile 32 is sinusoidal, j, the multiple of n in harmonics, is 1. Thus 4 piston-assemblies, or p=4, is not a factor of $(n\times j-1)=1$, $(n\times j)=2$, and $(n\times j+1)=3$. As a result, the piston-assembly forces and torques are balanced for the unperturbed piston-assembly displacement profile 32. The perturbations to the barrel-cam's piston-assembly displacement profile that result in 34 balance the component of valve assembly actuation forces in the direction of piston motion without introducing new torques.

FIG. 7—Preferred Embodiment

FIG. 7 shows a conceptual drawing of a completely balanced, 4 cylinder, 2 reciprocation per revolution, sinusoidal (including an arbitrary 3rd harmonic) piston-assembly displacement profile with valve-assembly balancing perturbations, barrel-cam engine as proposed in the present invention. FIG. 7 shows such a 4 cylinder barrel-cam engine that is "unrolled". The components 34, 36, and 38 are each connected with itself at the 0° and 360° points and rotate in unison similarly as in FIG. 2. In FIG. 7, n, the number of single piston-assembly oscillations defined through one rotation of the barrel-cam's piston-assembly displacement profile, is 2. Since the unperturbed piston-assembly displacement profile 32 is sinusoidal with a 3rd harmonic, j, the multiple of n in harmonics, has the set of possible values of {1, 3}. Thus 4 piston-assemblies, or p=4, is not a factor of any of the elements of $\{(n\times j-1)\}=\{1,5\}$, $\{(n\times j)\}=\{2,6\}$, and $\{(n\times j+1)\}=\{3,7\}$. As a result, the piston-assembly forces and torques are balanced for the unperturbed piston-assembly displacement profile 32. The perturbations to the barrel-cam's piston-assembly displacement profile that result in 34 balance the component of valve-assembly actuation forces in the direction of piston motion without introducing new torques. FIG. 7 is an illustration that barrel-cam piston-assembly displacement profiles such that the pistons stay at TDC and BDC longer than conventional engines (which would approximately correspond to a sinusoidal piston-assembly displacement profile) can also result in balanced operation. By phase shifting the 3rd harmonic of the piston-assembly displacement profile, unequal upstroke and downstroke shaft rotation can be obtained as in FIG. 5. These are only a few examples of the variety of piston-assembly displacement profiles that result in balanced operation.

FIG. 8—Operational Embodiment

FIG. 8 shows an isometric view of an operational piston-assembly arrangement made possible by FIG. 6 or FIG. 7 for a completely balanced, 4 cylinder, 2 reciprocation per revolution barrel-cam engine. Part motions are analagous to those of FIGS. 1A and 1B.

Advantages

From the description above, a member of advantages of the present invention become evident. Specifically, the present invention offers more diverse and compact choices of barrel-cam engine configurations with the following benefits:

(a) The present invention makes naturally balanced operation possible with only a single barrel-cam and single-ended piston-assemblies (standard pistons) which was not always possible in prior art. With naturally balanced operation, there is no need for balance shafts. This results in a reduction in engine part numbers and size.

(b) The present invention ensures naturally balanced operation for a class of barrel-cam piston-assembly displacement profiles that is more general than the sinusoidal displacement profile which has been favored in prior art of single barrel-cam engines. Relaxing the choices for barrel-cam piston-assembly displacement profiles can lend to better application specific design of barrel-cam internal-combustion engines.

(c) The present invention ensures naturally balanced operation for a larger choice in number of cylinders than apparent in prior art.

(d) The present invention still allows the simplified valve-actuating-cam coupling to the barrel-cam shaft demonstrated in prior art, under the same conditions necessary in prior art.

(e) The present invention does not require re-engineering of the thermodynamic, fluid, or combustion aspects of the engine—ie. the piston, combustion chamber, and valves.

(f) The present invention can be designed without sacrificing mechanical efficiency compared to conventional crank-type internal-combustion engines, while maintaining advantages (a)–(e), through arguments considering frictional forces and corresponding surface travel distances.

Conclusions, Ramifications, and Scope

The advantages stated in the previous section make it clear that the balanced barrel-cam internal-combustion engine of the present invention uses less components and also yields equal or lesser NVH (Noise and Vibrational Harshness), both without sacrificing mechanical efficiency when compared to prior art in barrel-cam engines and conventional crank-type engines. As an illustration of these advantages, under the conditions outlined in the present invention, a 4 cylinder single barrel-cam engine that is naturally balanced can be realized that is much simpler than the naturally balanced configurations of prior art. This can serve as a cost effective alternative for a power plant in passenger vehicles used for commuting where typically 4–6 cylinders are used. The present invention is in no way limited to 4 cylinder engines. It can be extended to a variety of number of cylinders, single-ended or double-ended piston-assemblies, and a variety of barrel-cam piston-assembly displacement profile through the stated conditions of the present invention.

I claim:

1. A balanced barrel-cam internal-combustion engine comprising:

(a) a rotating barrel cylinder through which rotational power can be transmitted, (b) a plurality of p reciprocating piston-assemblies in uniformly spaced planetary arrangement about said rotating barrel cylinder, each that includes a piston head at one or both of the ends, a linear bearing segment to ensure exclusively rectilinear non-rotational motion of said piston-assembly, and a dual roller axial cam follower, (c) a plurality of engine valve-assemblies per said piston-assembly, (d) a restrained fixture equivalent to an engine block which houses said rotating barrel cylinder, said engine valve-assemblies, and said plurality of p reciprocating piston-assemblies, (e) a barrel-cam, also known as a conjugate axial cam, that is attached to the cylindrical surface of said rotating barrel cylinder, that compliments each said dual roller axial cam follower such that the said barrel-cam's displacement profile for each said piston-assembly has n oscillations per revolution of said rotating barrel cylinder and consists of a set, denoted as J, of 1st and any higher harmonics, such that for all j from said set of harmonics J as well as for said values of p and n, p is not a factor of the expressions $n \times j-1$, $n \times j$, and $n \times j+1$ whereby perfect balancing of aggregate piston-assembly forces and torques is achieved.

2. A balanced barrel-cam internal-combustion engine comprising:

(a) a rotating barrel cylinder, a plurality of p reciprocating piston-assemblies, a plurality of engine valve-assemblies per said piston-assembly, and a restrained fixture, each as described in claim 1, (b) a barrel-cam, also known as a conjugate axial cam, that is attached to the cylindrical surface of said rotating barrel cylinder, that compliments each said dual roller axial cam follower such that the said barrel-cam's displacement profile for each said piston-assembly has an even number of n oscillations per revolution of said rotating barrel cylinder and consists of a set of fixed perturbations in addition to a set, denoted as J, of 1st and any higher harmonics, such that for all j from said set of harmonics J as well as for said values of p and n, p is not a factor of the expressions $n \times j-1$, $n \times j$, and $n \times j+1$ whereby perfect balancing of aggregate piston-assembly forces and torques is achieved and furthermore such that the said perturbations balance the valve-assembly forces in the direction of said piston-amenably motion without introducing additional torque imbalances.

* * * * *